US005740852A

United States Patent [19]

Feuerstacke et al.

[11] Patent Number: 5,740,852

[45] Date of Patent: Apr. 21, 1998

[54] CONVEYOR BELT FOR USE IN A CONTINUOUS STRIP-CASTING DEVICE FOR THE CASTING OF METAL STRIPS

[75] Inventors: Ewald Feuerstacke, Dorsten; Helmut Schlechtriem, Duisburg; Ulrich Urlau; Wolfgang Reichelt, both of Moers; Karl-Heinz Spitzer; Paul Freier, both of Clausthal-Zellerfeld; Frank Koch; Joachim Koch, both of Osterode, all of Germany

[73] Assignee: Mannesmann Aktiengesellschaft, Düsseldorf, Germany

[21] Appl. No.: 666,464

[22] PCT Filed: Dec. 21, 1994

[86] PCT No.: PCT/DE94/01545

§ 371 Date: Jul. 22, 1996

§ 102(e) Date: Jul. 22, 1996

[87] PCT Pub. No.: WO95/17988

PCT Pub. Date: Jul. 6, 1995

[30] Foreign Application Priority Data

Dec. 27, 1993 [DE] Germany ..... 43 44 954.9

[51] Int. Cl.[6] ..... B22D 11/06

[52] U.S. Cl. ..... 164/429; 164/479

[58] Field of Search ..... 164/479, 481, 164/482, 429, 430, 431, 432, 433

[56] References Cited

FOREIGN PATENT DOCUMENTS 1-202347 8/1989 Japan ..... 164/431

*Primary Examiner*—Kuang Y. Lin

*Attorney, Agent, or Firm*—Cohen, Pontani, Lieberman, Pavane

[57] ABSTRACT

A conveyor belt of a continuous strip-casting device for casting strips of metal, particularly steel, which belt is guided by a driven drum and a drum horizontally adjacent to the driven drum and displaceable for tensioning the belt. The belt rests in this connection on a support arranged between the drums and the side thereof facing away from the cast strip is cooled. The conveyor belt has, on the side remote from the cast strip, uniformly distributed blind holes. The blind holes are separated by webs of a minimum width. The total surface area of the webs is 0.15 to 0.4 times the total surface area of the belt. The bottoms of the blind holes have a wall thickness which, upon heating by the cast strip with simultaneous cooling of the inside surface of the blind holes, permits a bulging of the bottom of less than 1 mm.

9 Claims, 2 Drawing Sheets

CONVEYOR BELT FOR USE IN A CONTINUOUS STRIP-CASTING DEVICE FOR THE CASTING OF METAL STRIPS

BACKGROUND OF THE INVENTION

1. Field of the Invention

The present invention relates to a conveyor belt of a continuous strip-casting device for casting strips of metal, particularly steel. The belt is guided in a driven drum and by a drum horizontally adjacent to it and displaceable for tensioning of the belt. The belt rests in this connection on a support arranged between the drums and the side facing away from the cast strip is cooled.

2. Description of the Prior Art

Such a conveyor belt is known, for instance, from of German reference DE 34 23 834 C2, in which a metal strip is conducted over support rolls and cooled on the surface thereof facing away from the cast strand. In this case the metal strip is conducted around a plurality of support rollers at least one of which serves as a tensioning roller for the metal strip and at least one of which is driven in rotation. Upon the impingement of the molten metal from the supply container which is open on the bottom, the conveyor belt is heated so strongly on the side facing the cast strand as to produce distortions which extend into the cast strand and deform it. The bulges thus produced reach dimensions perpendicular to the plane of the conveyor belt which are of the order of magnitude of the thickness of the conveyor belt and a multiple thereof. These bulges may reach dimensions in the plane of the conveyor belt of 10 to 20 times the thickness of the conveyor belt and can have a size in the plane perpendicular to the direction of the conveyor belt of 0.8 to 0.9 times the width of the cast strand.

German DE OS 27 09 540, discloses a process and an apparatus in which cast strips are cooled by a cooling liquid from the side facing away from the pouring chamber. In this connection the cooling liquid produces hydrostatic forces which act on the rear of the cast strip, prevent distortion of the cast strip in the region of the pouring chamber and hold and guide the strip in a predetermined position. For this purpose, at a slight distance behind the cast strip there is arranged a guide plate which has feed and discharge openings through which cooling liquid flows onto the rear of the cast strip and cools it over its entire surface. Thus, a positive and negative hydrostatic pressure field are produced with respect to the atmosphere surrounding the strip so that the cast strip assumes a certain distance from the guide plate and is therefore held and guided in stable manner over the entire surface of the pouring chamber.

The thickness of the cast strips is between 0.5 and 2 mm. The proposed device is used in connection with downwardly inclined casting devices in which a relatively high pressing results on the ingot strips and their supports in the deep molten-metal phase in the cast material as a result of the metallostatic pressure.

In the absence of such a strong opposing pressure, for instance in continuous strip-casting devices with cast strands conducted horizontally on conveyor belts, there will continue to be clear distortions in view of the low weight of the cast strand.

SUMMARY OF THE INVENTION

The object of the present invention is to provide an easily maintained conveyor belt which, while having a long life, avoids by simple means quality defects in the cast strand which are caused by undulated distortion of the conveyor belt in the macro range.

Pursuant to this object, and others which will become apparent hereafter, one aspect of the present invention resides in a conveyor belt for a continuous strip casting device for casting a strip of metal, which conveyor belt includes an outer side on which the strip of metal can be supported and an inner side that faces away from the cast strip. A plurality of uniformly distributed blind holes are provided in the inner side of the belt. The blind holes are separated by webs having a minimum width so that a total surface area of the webs is 0.15 to 0.4 times the total surface area of the belt. Each of the blind holes has a bottom with a wall thickness that bulges less than 1 mm upon heating of the web by the cast strip and simultaneous cooling of the inside surface of the blind hole. In accordance with the invention, the conveyor belt, while retaining its flexibility, has a shape which permits bulging in the micro range, but at the same time is so structured that distortion in the macro range is definitely avoided.

For this purpose, the conveyor belt is provided with blind holes of a round or polygonal shape which have at their head side such a slight wall thickness as to permit a membrane-like deformation in the shadow of the blind hole, the webs of which, however, are of such a high strength that no macro bulges are formed.

The bottoms of the blind holes are so designed that they bulge less than 1 mm. These small changes in shape do not result in any quality-reducing deformations of the cast strip which is being produced. At the same time, the dimensions both in length and in width and in height of the entire conveyor belt remain within pre-established limits. In one advantageous further embodiment of the invention, the conveyor belt is of a so-called sandwich construction. In this connection, the outer surface of the endless conveyor belt, and therefore the surface which comes into contact with the cast strand, is formed of a material of high thermal conductivity, such as copper, while the cooled grid which, in particular, takes up the pulling forces, consists of a bending-resistant and temperature-stable material, such as fine-grain steel. By this construction, advantages in manufacture can be obtained and the conveyor belt can be easily imparted with specific physical properties.

The total number of openings, and therefore of blind holes, relative to solid material, and therefore the webs, is selected between 15 and 40%. The dimension of the strip is so selected, with due consideration of the material used, that, aside from the desired microbulges, no other deformations outside of predetermined limits occur.

BRIEF DESCRIPTION OF THE DRAWING

One embodiment of the invention is shown in the accompanying drawing, in which.

DETAILED DESCRIPTION OF THE PREFERRED EMBODIMENTS

Figure 1:
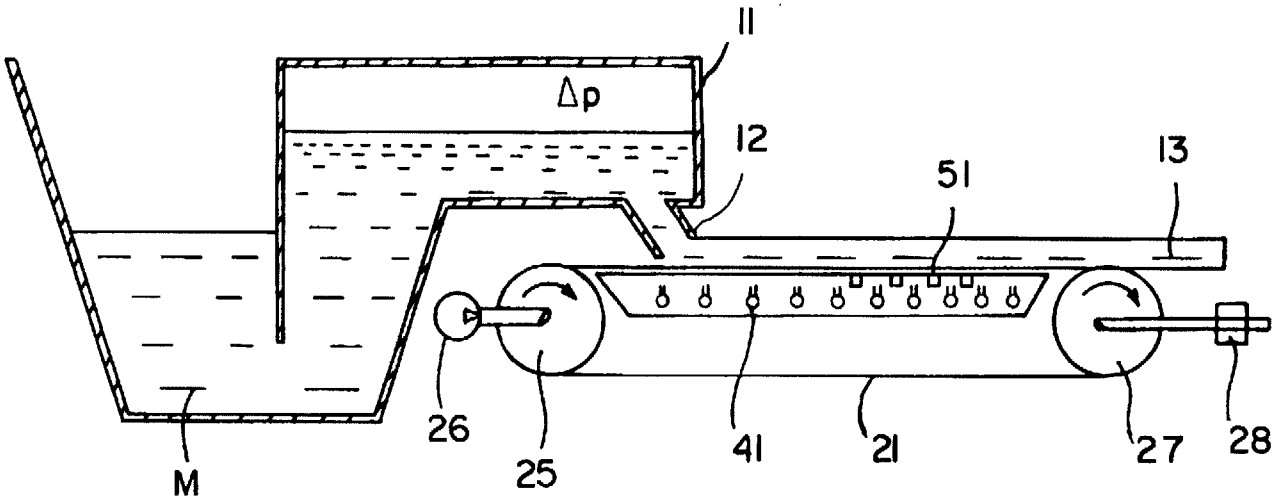
FIG. 1 shows a diagram of a continuous strip casting device.

FIG. 1 shows a supply container 11 of a continuous strip casting device containing liquid material M; the surface of which is raised above the outlet 12 of the container 11 by a vacuum p. The metal flowing out of the outlet 12 falls upon a conveyor belt 21 and is moved away from the supply container 11 in the form of a continuously cast strip 13.

The conveyor belt 21 is part of a conveyor device that includes a drum 25 which is driven by a motor 26 and a drum 27 which is tensioned by a tensioning device 28.

The upper course of the conveyor belt 21 rests on supports 51 and is cooled by cooling water fed by spray nozzles 41 on the side opposite the cast strip 13.

Figure 2A:
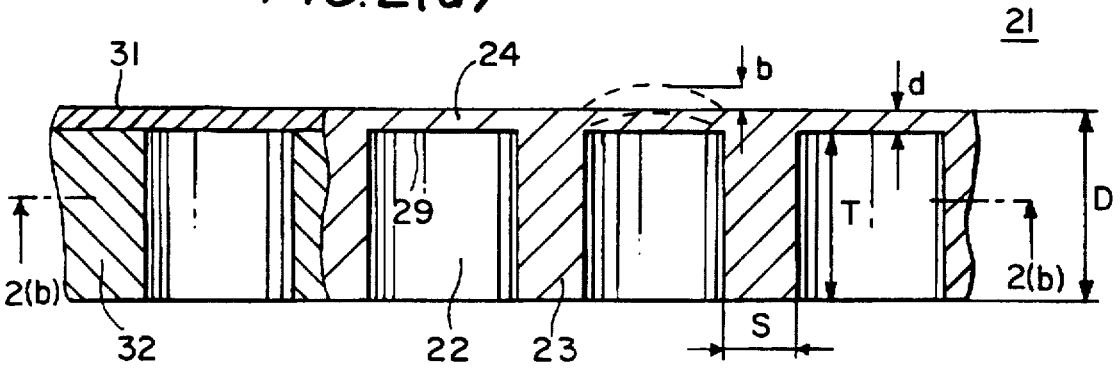
FIG. 2 are sections through the inventive conveyor belt.

FIG. 2*a* shows, in cross section, a part of the conveyor belt 21 in which blind holes 22 are present. Between the blind holes webs 23 having a minimum width S remain. The or bottom 24 of the blind holes have a wall thickness d, which together with a hole depth T for the blind holes 22 makes up the thickness D of the conveyor belt. The inside of the blind hole 22 can be sprayed by a cooling liquid so that, as a result of the temperature difference between the side of the blind hole bottom 24 facing the cast strip 13 as compared with the cooled blind hole inside surface 29, a bulging b of the blind hole bottoms 24 occurs.

In the upper left region of FIG. 2*a* there is shown a conveyor belt of sandwich construction, the layer 31 facing the cast strip being firmly attached to the layer 32 remote from the cast strip.

Figure 2B:
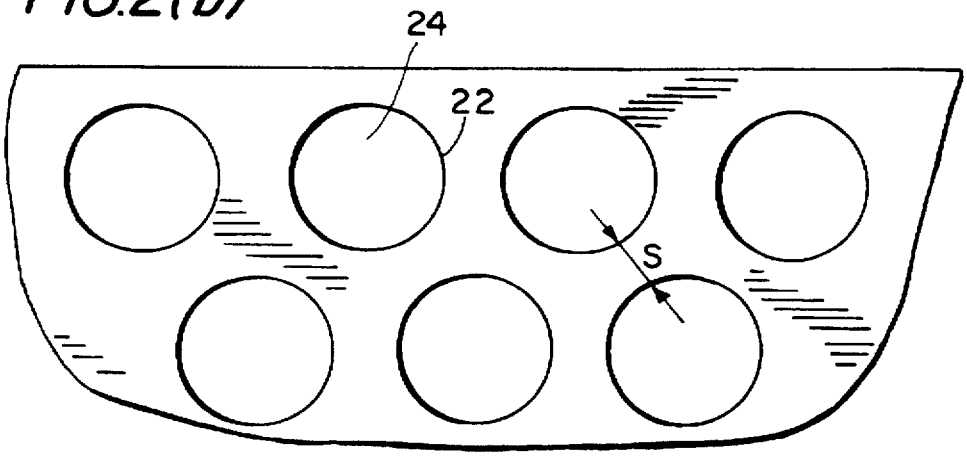
Figure 2C:
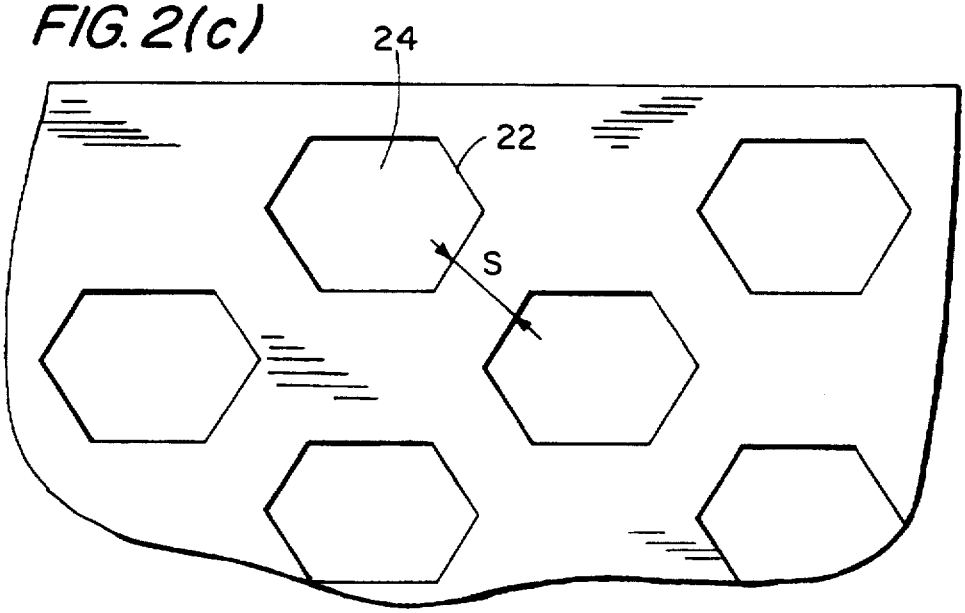

FIGS. 2*b* and 2*c* show, possible forms of blind holes, namely blind holes of circular and hexagonal shape, which have the minimum webs spacing S from each other.

We claim:

1. A conveyor belt of a continuous strip casting device for casting a strip of metal, the conveyor belt comprising an outer side on which the strip of metal can be supported and an inner side that faces away from the cast strip, a plurality of uniformly distributed blind holes being provided in the inner side of the belt, the blind bores being separated by webs having a minimum width so that a total surface area of the webs is 0.15 to 0.4 times a total surface area of the belt, the blind holes each having a bottom with a wall thickness which, upon heating of the web by the cast strip and simultaneous cooling of an inside surface of the blind holes permits a bulging of the bottom of the blind holes of less than 1 mm.

2. A conveyor belt according to claim 1, wherein the blind holes have a circular cross-section.

3. A conveyor belt according to claim 1, wherein the blind holes have a polygonal cross-section.

4. A conveyor belt according to claim 3, wherein the blind holes have a hexagonal cross-section.

5. A conveyor belt according to claim 1, wherein the conveyor belt is constructed of two layers which are intimately attached to one another, the layers including a first layer that faces the cast strip and has a thickness equal to that of the blind hole bottoms, and a second layer remote from the cast strip formed of a grid having a height equal to a depth of the blind holes.

6. A conveyor belt according to claim 5, wherein the first layer consists of a material of high thermal conductivity and the second layer consists of a layer which is resistant to bending and temperature changes.

7. A conveyor belt according to claim 6, wherein the first layer consists of copper.

8. A conveyor belt according to claim 6, wherein the second layer consists of a fine-grain steel.

9. A conveyor belt according to claim 1, and further comprising a drive drum, an adjustable drum arranged horizontally adjacent to the drive drum so as to permit tensioning of the belt, a support arranged between the drums, the belt being wrapped around the drum so as to pass over the support, and means for cooling the inner side of the belt.

* * * * *